United States Patent [19]

Lameka et al.

[11] Patent Number: 5,036,558

[45] Date of Patent: Aug. 6, 1991

[54] WALL BED IMITATION FIREPLACE

[76] Inventors: Gerald Lameka; William Hallman, both of 1060 Newby St., Glendale, Calif. 91201

[21] Appl. No.: 566,551

[22] Filed: Aug. 13, 1990

[51] Int. Cl.[5] ..... A47C 17/40

[52] U.S. Cl. ..... 5/136; 5/159.1; 5/160; 5/164.1

[58] Field of Search ..... 5/2.1, 136, 159.1, 160, 5/164.1

[56] References Cited

U.S. PATENT DOCUMENTS

| | | | |
|---|---|---|---|
| 1,380,502 | 6/1921 | Sinclair | 5/164.1 |
| 1,724,066 | 8/1929 | Bean | 5/2.1 |
| 2,316,681 | 4/1943 | Ferrier | 5/2.1 X |
| 2,607,046 | 8/1952 | Driver | 5/2.1 |
| 2,634,434 | 4/1953 | Driver | 5/160 X |
| 2,747,202 | 5/1956 | Driver | 5/136 X |
| 2,842,777 | 7/1958 | Wheeler | 5/159.1 |
| 3,858,253 | 1/1975 | Lauzon | 5/2.1 |

*Primary Examiner*—Michael F. Trettel

*Attorney, Agent, or Firm*—Plante, Strauss, Vanderburgh & Connors

[57] ABSTRACT

Disclosed is a wall bed within an enclosure that looks like a fireplace when the bed is in a vertical position.

9 Claims, 6 Drawing Sheets

WALL BED IMITATION FIREPLACE

BACKGROUND OF THE INVENTION

1. Field of the Invention

This invention relates to wall beds, and in particular, a wall bed which, when hidden from view, is enclosed within a structure that looks like a fireplace.

2. Background Discussion

Wall beds are well known devices which enable a bed to be stored in an upright, generally vertical position, hidden within a wall or a cabinet when not in use. When the bed is to be used, the cabinet or other enclosure is opened and the bed is moved from the vertical to a horizontal position. The conventional enclosures are usually cabinet-type structures that look like an armoire.

SUMMARY OF THE INVENTION

The present invention provides a wall bed within an enclosure that looks like a fireplace when the bed is in a vertical position.

The wall bed imitation fireplace of this invention has several features, no single one of which is solely responsible for its desirable attributes. Without limiting the scope of this invention as expressed by the claims which follow, its more prominent features will now be discussed briefly. After considering this discussion, and particularly after reading the section of this application entitled, "DETAILED DESCRIPTION OF THE PREFERRED EMBODIMENT," one will understand how the features of this invention provide its advantages.

The first feature of this invention is that the enclosure has an open front, a pair of aligned spaced apart sides, a top mantel piece and a base spaced apart and aligned with each other. A back wall connects the sides, mantel piece, and base so that the enclosure is a rigid, stable structure.

The second feature is that the enclosure has dimensions generally corresponding to the dimensions of a full size bed; for example, it has a width of approximately 77 to 89 inches, a depth of approximately 13 to 29 inches, and a height of approximately 55 to 59 inches. The sides are spaced apart a distance about equal to the length of the bed, and the base and mantel piece are spaced apart a distance about equal to the width of the bed. Thus, a full size bed oriented with one of its longitudinal sides near the base fits within the enclosure. The enclosure is a generally rectangular, box-like structure with a depth that does not exceed about 15 inches and a height that does not exceed about 60 inches.

The third feature is a box-like platform member received within the enclosure. This platform member has an underside surface and a topside surface, with the topside surface being generally flat and adapted to support a mattress for a full size bed. The surfaces have dimensions essentially the same as the dimensions of a full size mattress.

The fourth feature is that the platform member is connected by a hinge to the base of the enclosure to enable the platform to pivot about the hinge and move between a first upright, vertical position and second horizontal position. In the first position, the platform member is received within the enclosure, with the underside surface being vertically oriented and covering the open front of the enclosure. In the second position, the platform member extends outwardly from the open front of the enclosure in a substantially horizontal orientation, with the mattress resting on the topside surface.

The fifth feature is that the platform and enclosure, when the platform member is in the upright position, presents a fireplace facade. The underside surface of the platform member is exposed to view and it includes a firebox recess which is seen when the platform member is in the upright position, but faces downward and is hidden from view when the platform member is in the horizontal position.

The sixth feature is that the platform member has a rear wall that abuts the base of the enclosure when the platform member is in the upright position. There is an internal support structure within the platform member between the topside and underside surfaces. Springs serve to counterbalance the weight of the platform member as this member is moved between the upright and horizontal positions. These springs extend through an opening in the rear wall, having ends connected to the base and other ends extending into the hollow interior of the platform member and being connected to the support structure.

The seventh feature is that the support structure for the springs includes a removably mounted spring box located within the hollow platform member beneath doors in the topside surface that allow access to the spring box. The spring box includes a rod which is mounted to move along slot type guideways as the platform member is moved between the upright and horizontal positions. The ends of the springs extending into the platform are connected to the rod. Because of this mounting arrangement, if a spring breaks and needs to be replaced, the doors provide easy access to the spring box.

The eight feature is that the underside surface of the platform member has extending outwardly therefrom, preferably near an upper portion of the underside surface, a footing element that abuts a floor on which the enclosure is resting when the platform member is moved to the horizontal position. The footing element lifts the upper portion of the platform member off the floor on which it rests a sufficient distance so that the topside surface of the platform member is level.

DESCRIPTION OF THE DRAWING

The preferred embodiment of this invention, illustrating all its features, will now be discussed in detail. This embodiment depicts the novel and non-obvious wall bed imitation fireplace of this invention shown in the accompanying drawing, which is for illustrative purposes only. This drawing includes the following FIGS., with like numerals indicating like parts.

DETAILED DESCRIPTION OF THE PREFERRED EMBODIMENTS

The wall bed imitation fireplace 10 of this invention is best illustrated in FIGS. 1, 2, 3, and 6. This invention includes a cabinet-like enclosure 12 and a box like platform member 14 for supporting a mattress 16.

Figure 1:
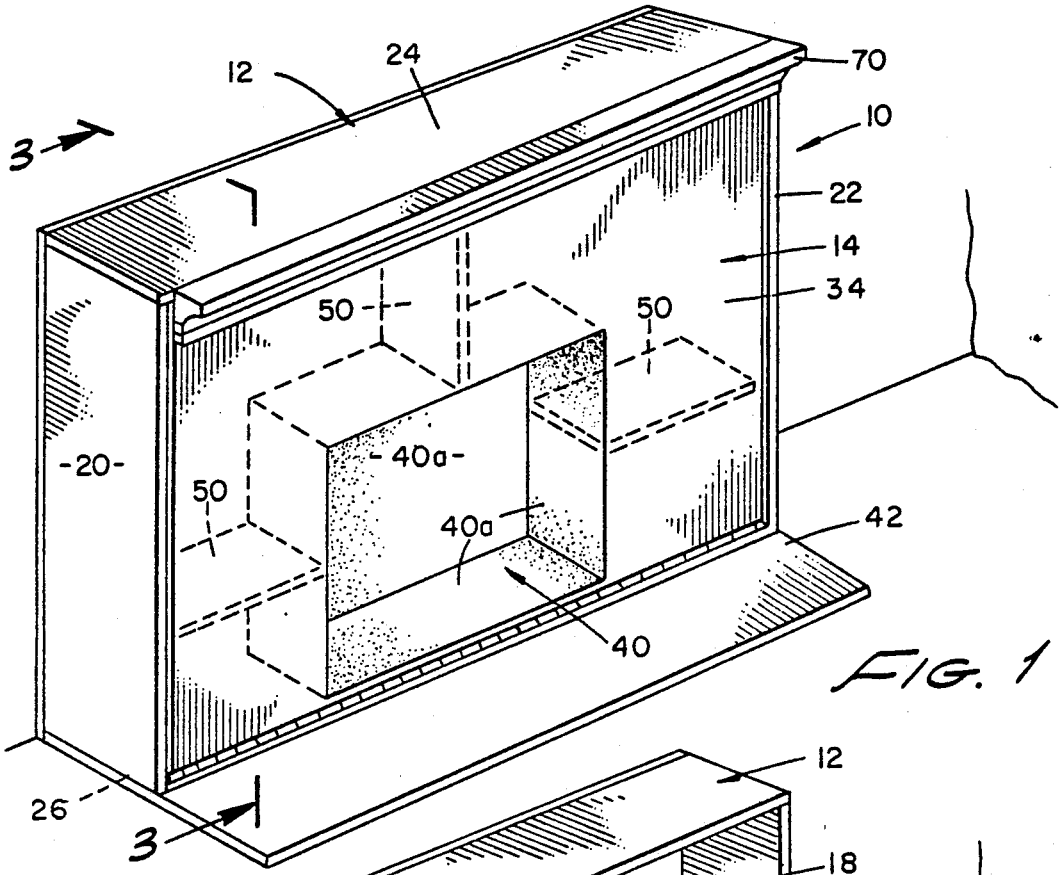
FIG. 1 is a perspective view of the wall bed imitation fireplace of this invention, with the platform in the upright position.
Figure 2:
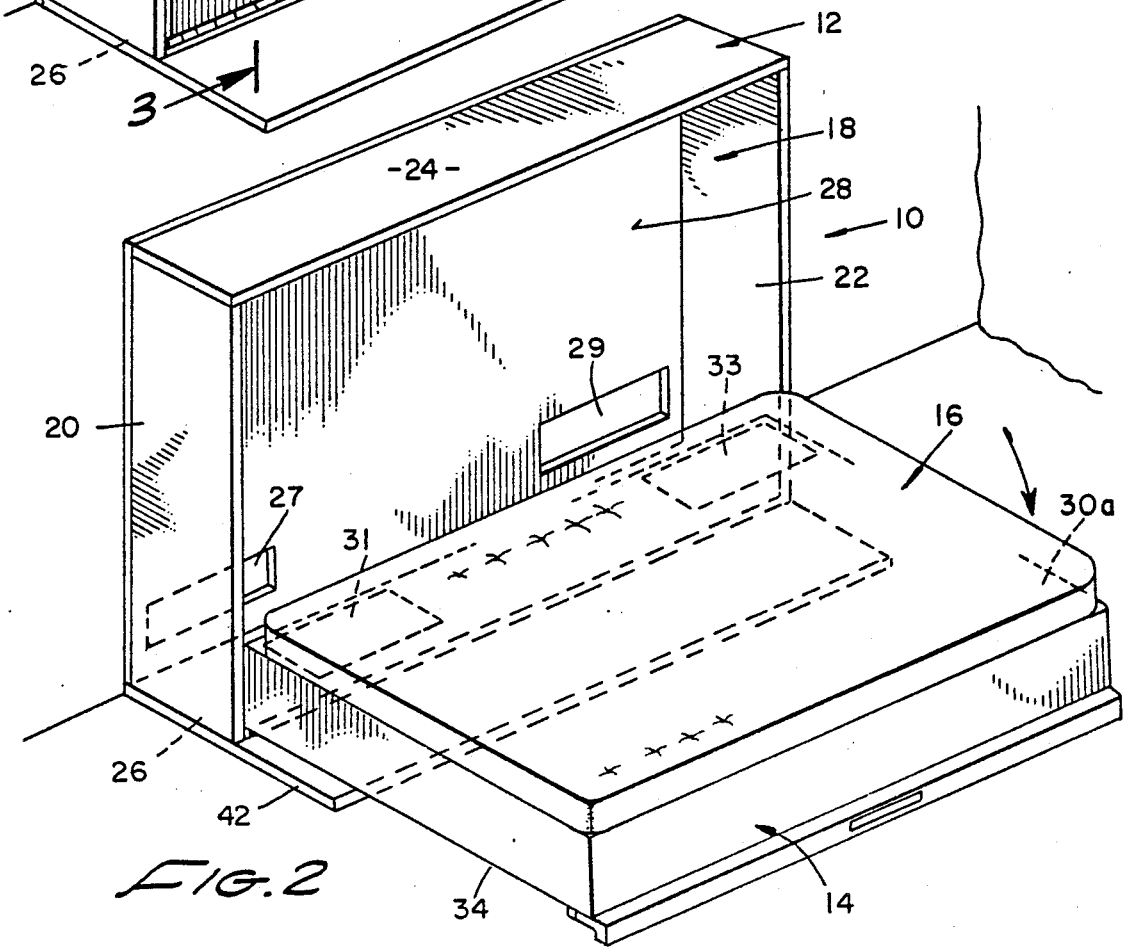
FIG. 2 is a perspective view of the wall bed imitation fireplace of this invention, with the platform in the horizontal position.

The enclosure 12 is a cabinet like structure with an open front 18 (FIG. 2) and a pair of vertical side walls 20 and 22, a top mantel piece 24 and a base 26, and a back wall 28 connecting the side walls, base, and mantel piece together to provide rigidity. The mantel piece 24 and base 26 are spaced apart a distance corresponding to the width of a full size bed, i.e., 55 inches. The two vertical sides 20 and 22 are spaced apart a distance corresponding to the length of a full size bed, i.e., 77 inches. The base 26 is secured, for example, by bolts or other fasteners (not shown), to a floor on which the enclosure 12 sets. Alternately, the back wall 28 may be fastened to a wall against which the back wall abuts. The platform member 14 is received within the enclosure 12, moving from a generally vertical position to a generally horizontal position, in and out of the open front 18 of the enclosure. This platform member 14 has a top cover 30, including a pair of doors 31 and 33 therein which, when opened, provide access to a spring box 35. The back wall 28 has a pair of doors 27 and 29 that allow access to the spring box 35. The top cover 30 has a generally flat topside surface **30*a* to which the mattress 16 is removably attached, for example, by hook and fabric type fasteners 32 (Velcro Brand fasteners) or other fastening means. The platform member 14 has an underside surface 34 spaced apart from the topside surface 30*a*, 8 inches. As best shown in FIG. 1, there are support members 50 (shown in phantom) extending crosswise within the platform member 14 connecting the walls of the member together. These support members 50** provide rigidity.

Figure 3:
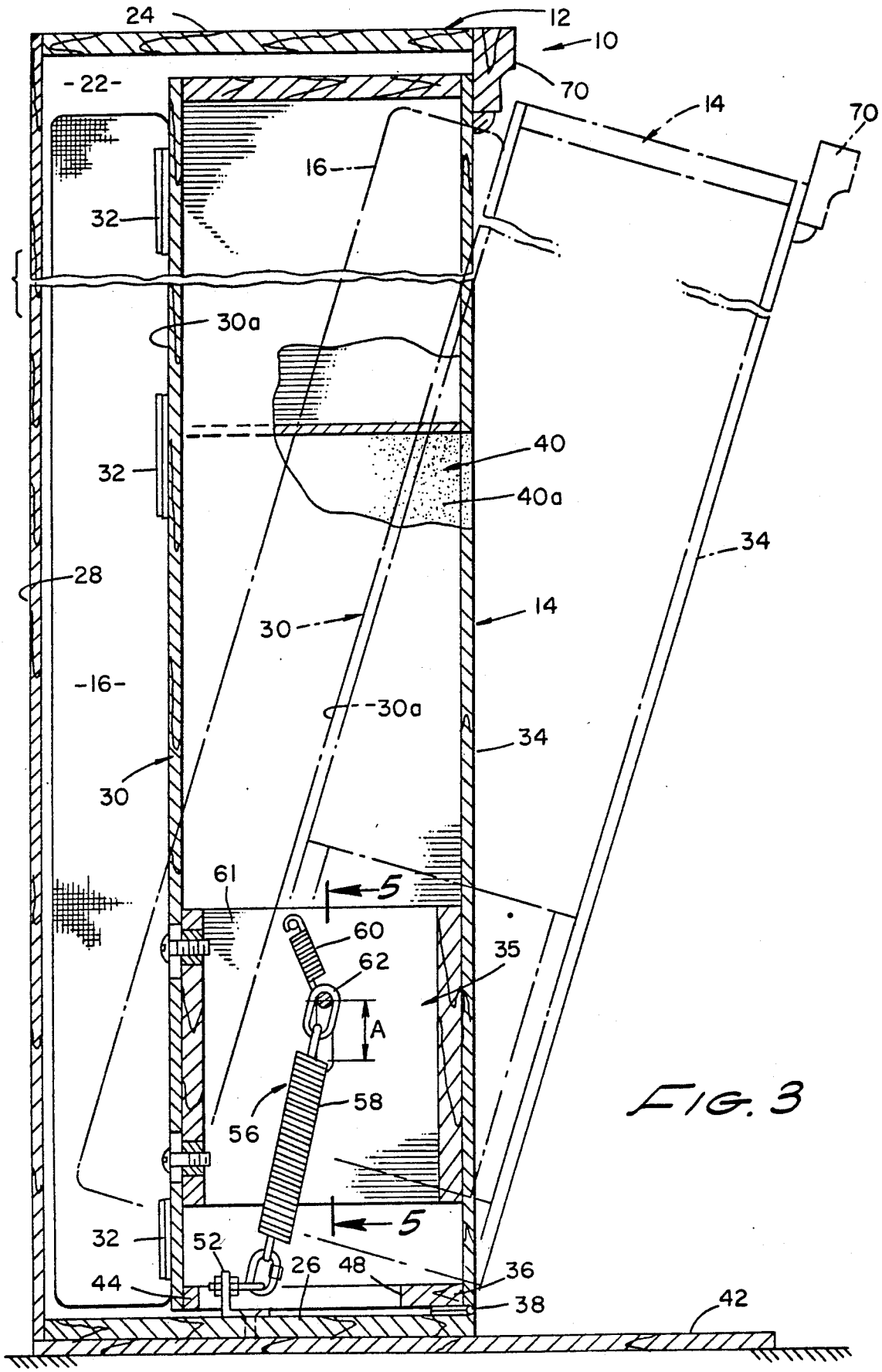
FIG. 3 is a cross-sectional view taken along line 3—3 of FIG. 1, with the phantom lines showing the platform member being moved from the upright to horizontal position.
Figure 4:
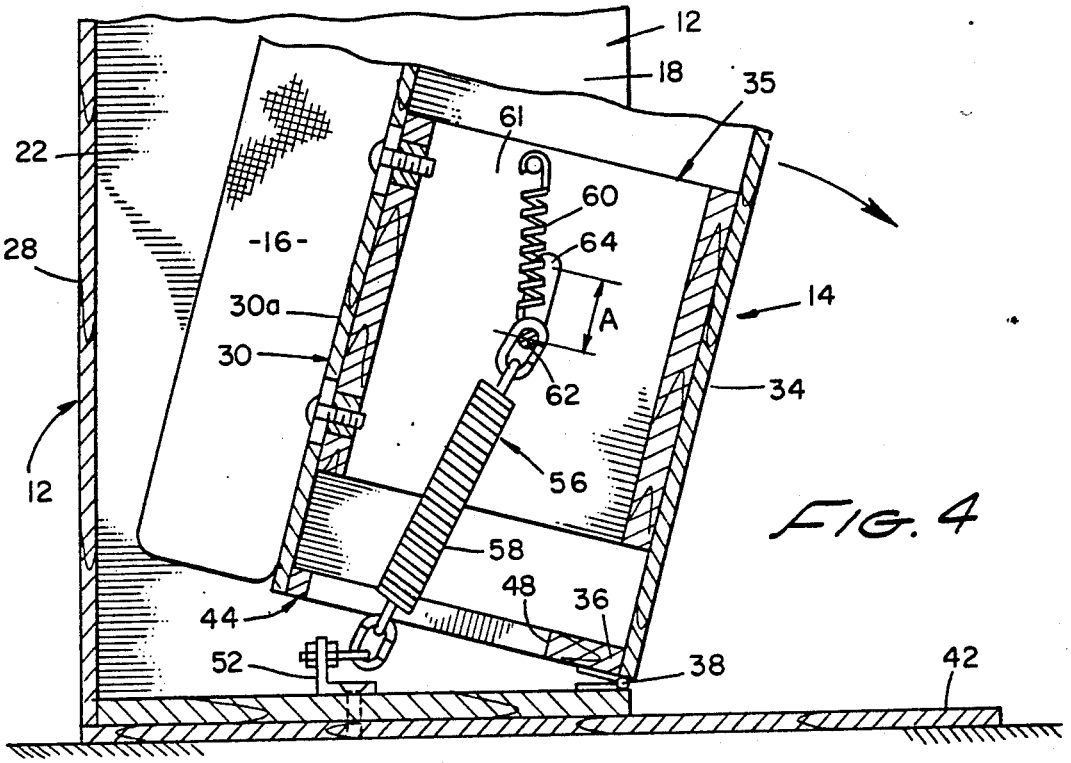
FIG. 4 is a cross-sectional view similar to that shown in FIG. 3 showing the action of the counter balancing spring members as the platform member is moved from the upright to horizontal position.
Figure 5:
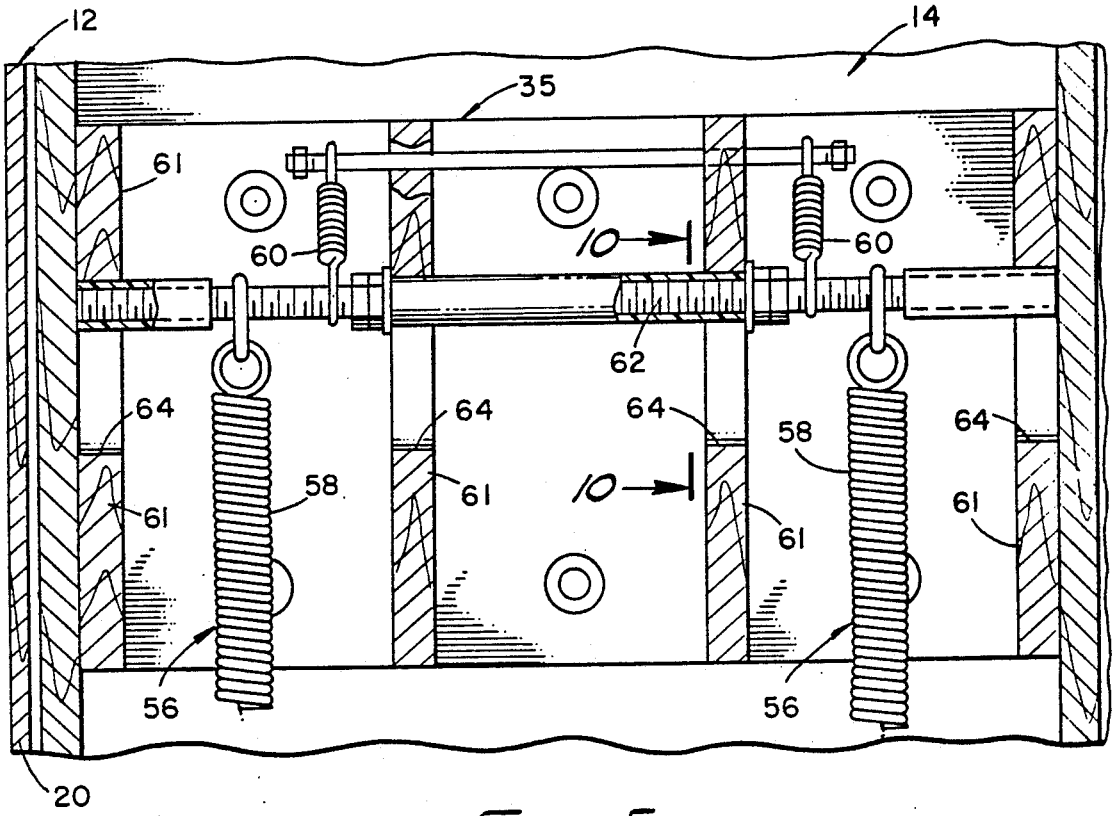
FIG. 5 is a cross-sectional view taken along line 5—5 of FIG. 3.

The combined height of the mattress 16 and platform member 14 does not exceed about 15 inches, which is about the depth of the enclosure. The lower longitudinal edge 36 of the platform member 14 is mounted by a hinge 38 to the base 26. A firebox 40 is built within the platform member. This firebox 40 is exposed to view when the platform member 14 is moved to the vertical position as shown in FIG. 1. The firebox 40 has a height of about 2 feet, a width of about 2½ feet, and a depth of about 8 inches. Its internal surfaces **40*a* are preferably black in color. With the platform member 14 in the upright position, the entire assembly of platform member 14 and enclosure 12 presents an imitation fireplace. Preferably, there is a hearth 42 adjacent to the open front 18 which may be removably attached to the base 26. This hearth 42 has a height about equal that of the height of the base. The hearth 42 may be integral with, or an extension of, the base as illustrated in FIG. 3**.

Figure 8:
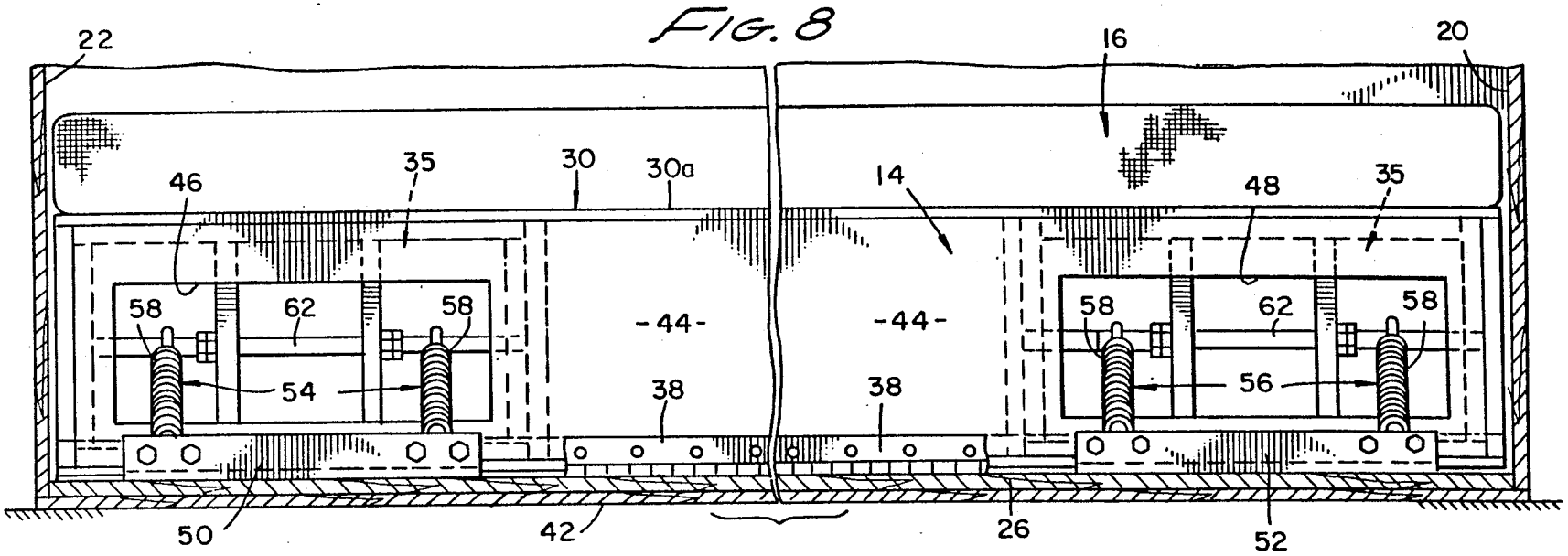
FIG. 8 is a cross-sectional view taken along line 8—8 of FIG. 6.
Figure 9:
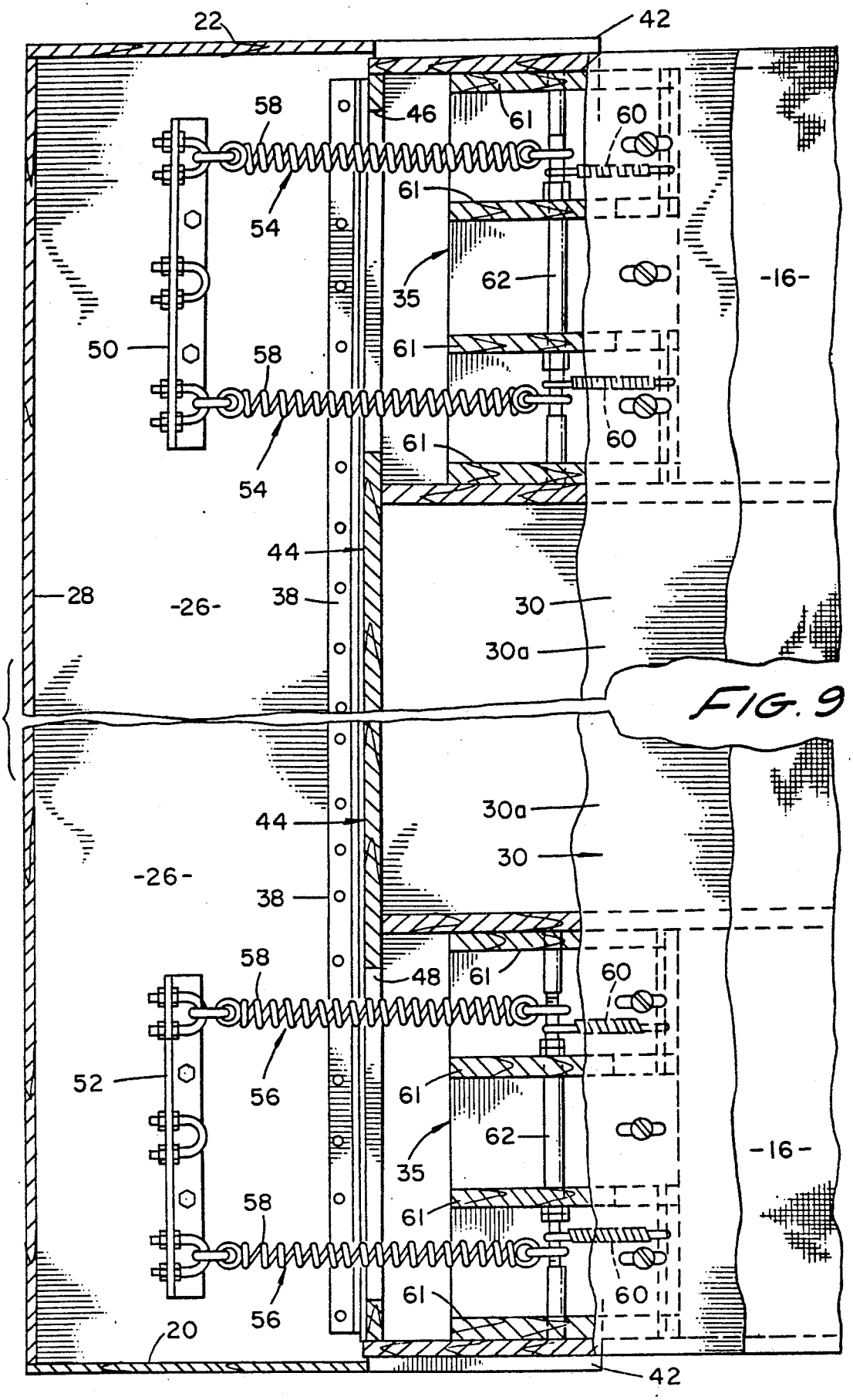
FIG. 9 is a cross-sectional view taken along line 9—9 of FIG. 6.

As best shown in FIGS. 8 and 9, the rear wall 44 of the platform member 14 has two openings 46 and 48 cut away in it to expose the hollow interior of the platform member 14. A pair of spaced bracket members 50 and 52 are bolted to the base 26 of the enclosure 12 and two pairs of spring assemblies 54 and 56 are mounted to these bracket members and extend through the openings 46 and 48 in the rear wall 44.

Figure 11:
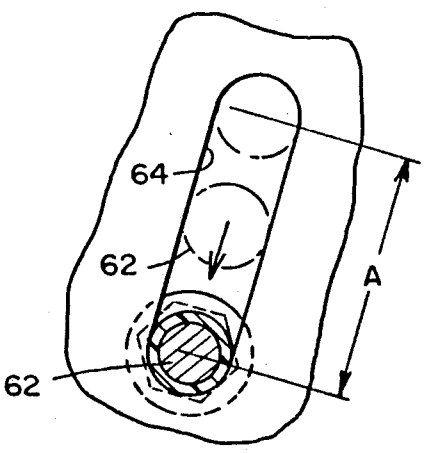
FIG. 11 is a fragmentary view of slots in the spring box showing a spring rod starting to move into the horizontal position.
Figure 12:
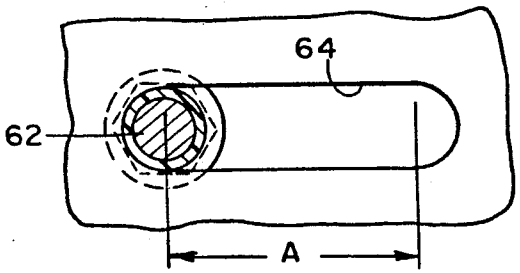
FIG. 12 is a fragmentary view of slots in the spring box showing a spring rod in the horizontal position.
Figure 10:
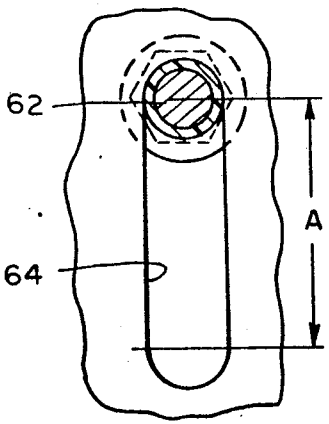
FIG. 10 is a fragmentary view of slots in the spring box showing a spring rod in the upright position.

These spring assemblies 54 and 56 serve as counterbalancing means that facilitate the platform member 14 being moved between the vertical and horizontal positions. Each spring assembly 54 and 56 has one long spring 58 and one short spring 60. The long springs 60 have ends connected securely to the brackets 50 and 52 as the case may be, and the short springs have ends connected securely to the walls 61 of the spring box 35. Each of the springs 58 and 60 have ends connected to a rod 62, with this rod extending lengthwise through elongated and aligned slots 64 in the walls 61. Thus, as the platform member 14 moves between the upright and horizontal positions, the rod 62 moves along the slots 64 as depicted in FIGS. 10 through 12. The distance between the ends of the slots 64 A allows the weak springs 60 to act as the principal counter balancing springs when the platform member 14 is initially opened. This is desirable so that relatively little force is needed to lower the platform member 14. Once the platform member 14 begins to assume a horizontal position the stronger springs 58 take over to serve as the principal counter balancing mechanism. The shifting of the position of the rod 62 between the ends of the slots 64 allows the stronger springs 58 to act as the principal counter balancing mechanism.

Figures 6, 7:
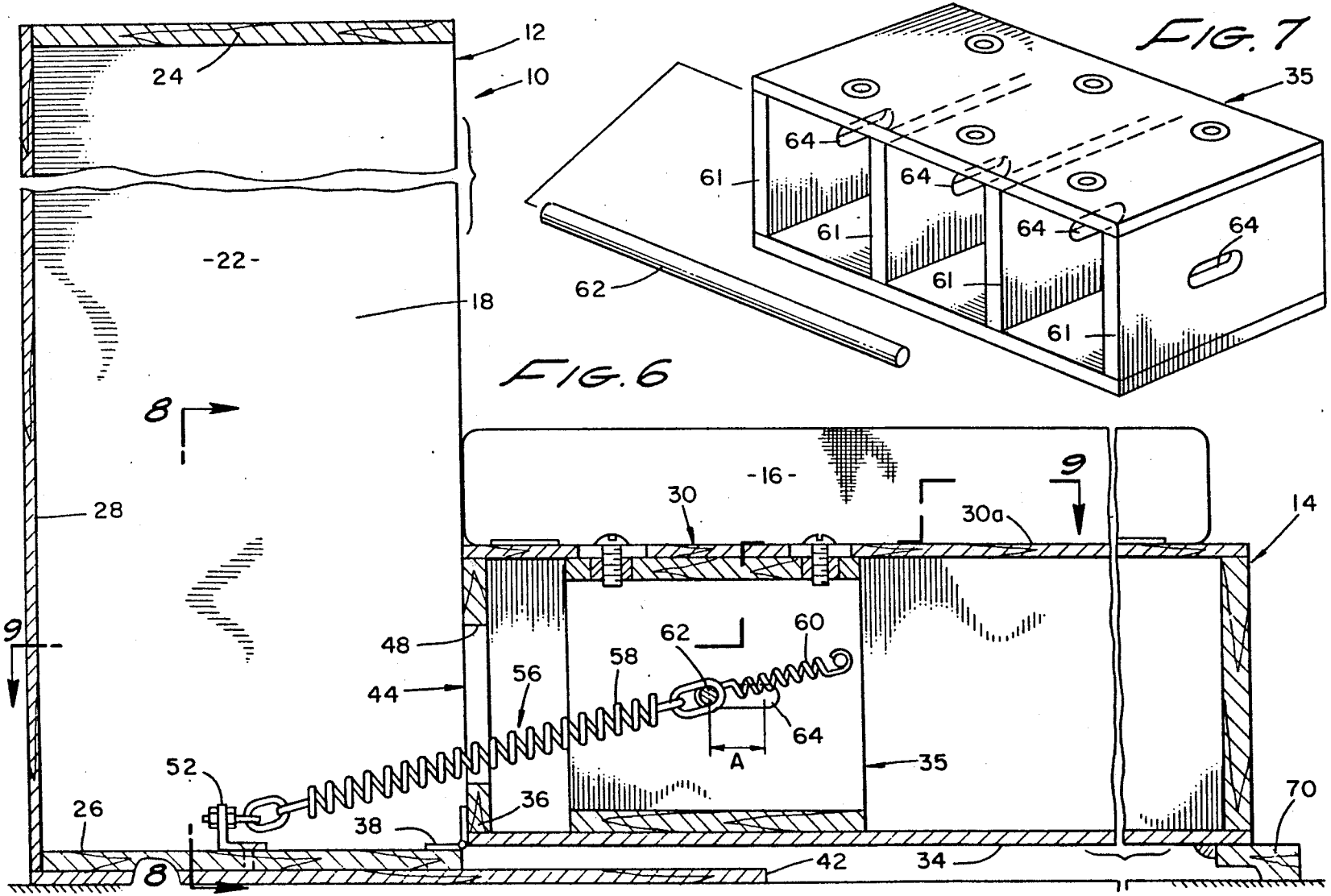
FIG. 6 is a side elevational view, partially in cross-section showing the platform in the horizontal position.
FIG. 7 is a perspective view of the support structure for the springs.

In accordance with one feature of this invention, the upper portion of the underside surface of the platform member 14 has a piece of molding 70 that extends along the length of the underside and, as illustrated in FIG. 6, acts as a footing when the platform member 14 is in the horizontal position. This molding 70 projects outwardly approximately a half an inch, which is about equal to the height of the base 26. Thus, when the platform member 14 is in the horizontal position, the edge of the molding 70 abuts the floor on which the enclosure 12 rests, so that the topside surface 30 will be level.

SCOPE OF THE INVENTION

The above description discloses the best mode contemplated of carrying out the present invention. This invention is, however, susceptible to modifications and alternate constructions from that discussed above. Consequently, it is not the intention to limit this invention to the particular embodiments disclosed. On the contrary, the intention is to cover all modifications and alternate constructions coming within the spirit and scope of this invention as generally expressed by the following claims:

We claim:

1. A wall bed imitation fireplace comprising an upright, generally vertically oriented enclosure having an open front, a pair of aligned, spaced apart sides, a top mantel piece and a base spaced apart and aligned with each other, and a back supporting means connecting the sides, mantel piece, and base, said enclosure having dimensions generally corresponding to a regular size bed, with said sides being spaced apart a distance about equal to the length of the bed and the base and mantel piece being spaced apart a distance about equal to the width of the bed, so that a regular sized bed oriented with one of its longitudinal sides near the base fits within the enclosure, a box-like platform member having an an underside surface and a topside surface which is substantially flat and is adapted to support a mattress for a regular sized bed, said surfaces having dimensions essentially the same as the dimensions of a regular sized bed, said platform member being connected by hinge means to the base of the enclosure to enable the platform member to pivot about the hinge means and move between a first position where the platform member is received within the enclosure with the underside surface in a generally upright, vertical orientation positioned to cover substantially the open front of the enclosure and a second position where the platform member extends outward from the open front of the enclosure in a substantially horizontal orientation, said platform member and the enclosure when the platform member is in the first position presenting a fireplace facade, with the underside surface of the platform section being exposed to view and including a fire box recess which is seen when the platform member is in the first position but faces downward and is hidden from view when the platform member is in the second position, spring means connected between the base of the enclosure and the platform member, and an internal support structure in the platform member having a rear wall that abuts the base of the enclosure when the platform member is in the first position, said rear wall having an opening therein with the spring means extending through the opening and being connected to the support structure.

2. The wall bed imitation fireplace of claim 1 wherein the underside surface has extending outwardly therefrom along an upper portion of said underside surface a footing element that engages a floor on which the enclosure is resting, said footing element lifting the upper portion off said floor on which the enclosure is resting a sufficient distance to oriented horizontally and level the topside surface of the platform member.

3. The wall bed imitation fireplace of claim 1 wherein the top mantel piece has a height which does not exceed 55 inches.

4. The wall bed imitation fireplace of claim 1 wherein the enclosure has a generally rectangular, box-like configuration with a depth that does not exceed about 15 inches.

5. The wall bed imitation fireplace of claim 1 wherein there is a removable hearth member positioned adjacent the base of the enclosure at the open front.

6. The wall bed imitation fireplace of claim 1 wherein the spring means includes a counterbalancing spring system mounted within the enclosure having a pair of springs, one spring being substantially stronger than the other and arranged so that the stronger spring is operable after the platform member has been displaced substantially from the upright position.

7. A wall bed imitation fireplace comprising an upright, generally vertically oriented enclosure having an open front and base, said enclosure having dimensions generally corresponding to a regular size bed, so that a regular sized bed oriented with one of its longitudinal sides near the base fits within the enclosure, a box-like platform member having an an underside surface and a topside surface which is substantially flat and is adapted to support a mattress for a regular sized bed, said surfaces having dimensions essentially the same as the dimensions of a regular sized bed, said platform member being connected by hinge means to the base of the enclosure to enable the platform member to pivot about the hinge means and move between a first position where the platform member is received within the enclosure with the underside surface in a generally upright, vertical orientation positioned to cover substantially the open front of the enclosure and a second position where the platform member extends outward from the open front of the enclosure in a substantially horizontal orientation, said platform member and the enclosure when the platform member is in the first position presenting a fireplace facade, with the underside surface of the platform section being exposed to view and including a fire box recess which is seen when the platform member is in the first position but faces downward and is hidden from view when the platform member is in the second position, and spring means connected between the enclosure and the platform member and which are at least partially enclosed within the platform member and attached to an internal support structure in the platform member.

8. The wall bed imitation fireplace of claim 7 wherein the enclosure has a mantel piece with a horizontally disposed molding element along a front, upper edge of said platform member adjacent to said mantel piece which acts as a footing element that engages a floor on which the enclosure is resting, said molding element lifting the platform member off said floor on which the enclosure is resting a sufficient distance to orient horizontally and level the topside surface of the platform member when the platform member is in the horizontal position.

9. The wall bed imitation fireplace of claim 7 wherein the spring means includes a counterbalancing spring system mounted within the enclosure having a pair of springs, one spring being substantially stronger than the other and arranged so that the stronger spring is operable after the platform member has been displaced substantially from the upright position.

* * * * *